United States Patent [19]

Aho

[11] 3,963,254

[45] June 15, 1976

[54] SNOW DISK FOR A SKI STAFF

[75] Inventor: Yrjo Aho, Westend, Finland

[73] Assignee: Exel Oy, Helsinki, Finland

[22] Filed: Mar. 24, 1975

[21] Appl. No.: 561,771

[30] Foreign Application Priority Data

Mar. 28, 1974 Finland ..... 957/74

[52] U.S. Cl. ..... 280/11.37 Z

[51] Int. Cl.[2] ..... A63C 11/24

[58] Field of Search ..... 280/11.37 Z, 11.32 N, 280/11.37 B

[56] References Cited

UNITED STATES PATENTS

| | | | |
|---|---|---|---|
| 3,866,931 | 2/1975 | Marker | 280/11.37 B |

FOREIGN PATENTS OR APPLICATIONS

| | | | |
|---|---|---|---|
| 1,267,305 | 6/1961 | France | 280/11.37 Z |
| 11,785 | 4/1903 | Norway | 280/11.37 N |
| 527,678 | 10/1940 | United Kingdom | 280/11.37 N |

*Primary Examiner*—M. H. Wood, Jr.
*Assistant Examiner*—Milton L. Smith
*Attorney, Agent, or Firm*—Haseltine, Lake & Waters

[57] ABSTRACT

An asymetric disk for a ski staff with hand straps, in which the front edge of the disk is in close proximity to the staff. Only the rear edge and/or the lateral edge of the disk extend to form the bearing surfaces of the disk. The hand straps are attached to the staff on the side of the rear edge. The disk is rigid in its central area and is keyed to the shaft so as not to be rotatable thereon.

7 Claims, 6 Drawing Figures

SNOW DISK FOR A SKI STAFF

BACKGROUND OF THE INVENTION

The traditional snow disk of a ski staff consists of a circular peripheral hoop and, attached to this, leather strips crossing at the center of the disk. At the crossing point the staff has been attached. The advantages of this type of disk are that a large surface area is obtained as well as elasticity of the central area of the disk. However, on hard race trails, for instance, the large disk area is not needed and it may even be objectionable owing to resistance of air. In addition to this, the traditional disk type is comparatively heavy, expensive and poorly suited for series production. Accordingly, in recent time, disks of plastic material have increasingly replaced this traditional disk type.

A feature common to all disk arrangements of prior art is a fairly symmetrical construction. Now the introduction of plastic disks has resulted in a new drawback expressly due to the increased rigidity of the disk. When during the pushing motion, the staff is inclined forward, the leading edge of the disk exerts a counterforce, thus creating the risk that the spike part may rise out of the snow and the staff may slip backwardly. It is further noted that the staff is affected over its entire length by a moment causing it to curve, whereby the skiing is retarded and there is an increased risk of buckling. As a result, there is need of dimensioning for greater strength and increased weight of the staff. In attempts to correct this matter e.g. by making the central part of the disk as elastic as possible, the result is e.g. in the case of plastic disks that short-lived disk designs susceptible to damage are obtained, because known types of plastic cannot endure a continuous, severe deformation. Alternatively, one may arrive at expensive and complicated designs in which the disk has been made articulated or has been attached to the staff to be as easily turnable as possible. It has also been attempted to solve the problem in that the disk and the spike part of the staff have been bent at a given angle against the longitudinal axis of the staff so that when the staff is slightly forwardly inclined, the disk lies in the plane of the ground surface and the spike part is perpendicular against this plane. In this manner, the problem mentioned has been somewhat alleviated, but it has not been totally eliminated. In addition, when the staff is formed to be angulated as has been described, this causes a need for stronger dimensioning of the staff and results in an increased weight.

The object of the present invention is to provide an improved snow disk which is free of the drawbacks mentioned and which, in spite of this, has a design which is as simple, light, durable and inexpensive as possible. The snow disk according to the invention has been found to provide an unexpected solution.

In the following, the invention is described more closely with reference to the attached drawings.

DESCRIPTION OF THE PREFERRED EMBODIMENT

Figure 1:
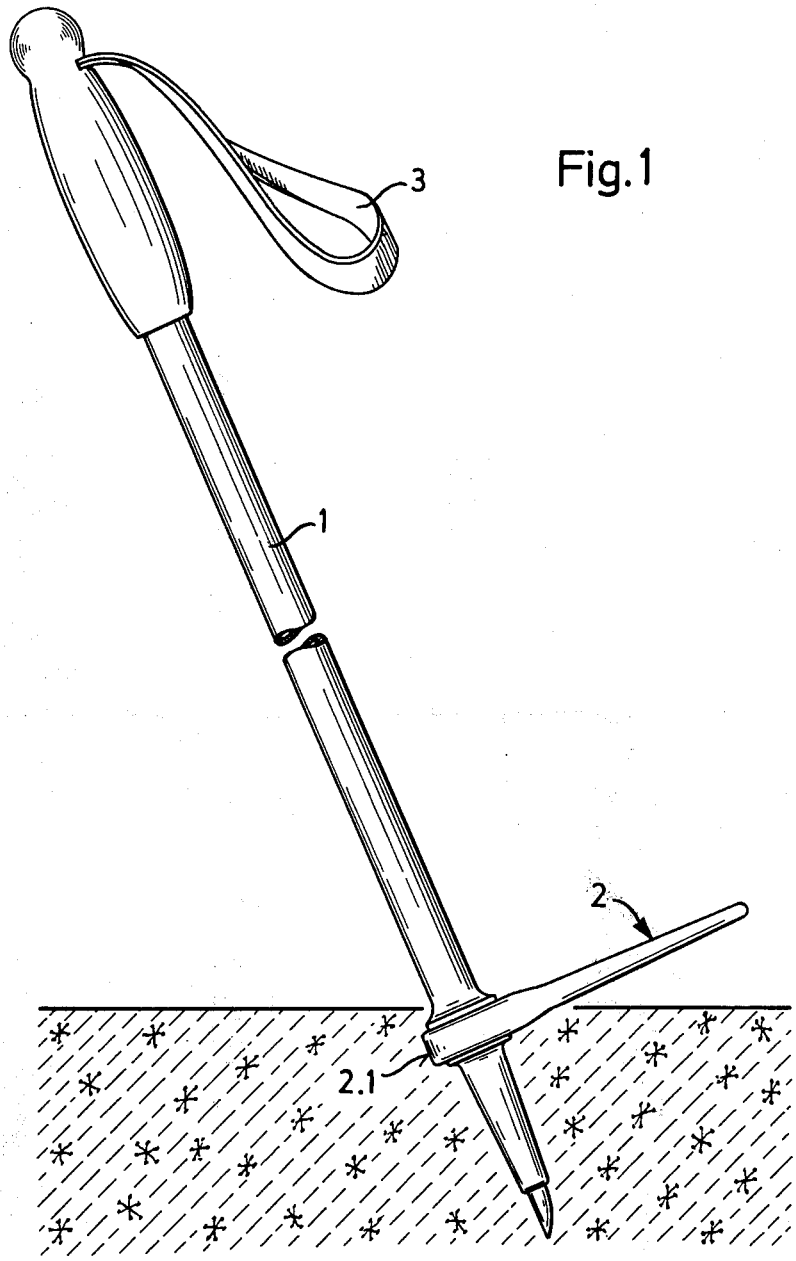
FIG. 1 shows a snow disk according to the invention, in elevational view.
Figure 2:
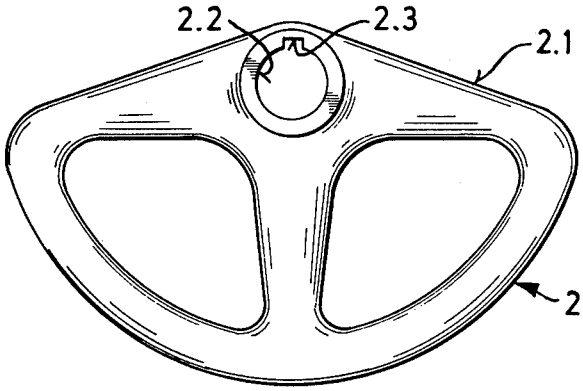
FIGS. 2 to 4 show various disk types according to the invention, viewed from above.
Figure 3:
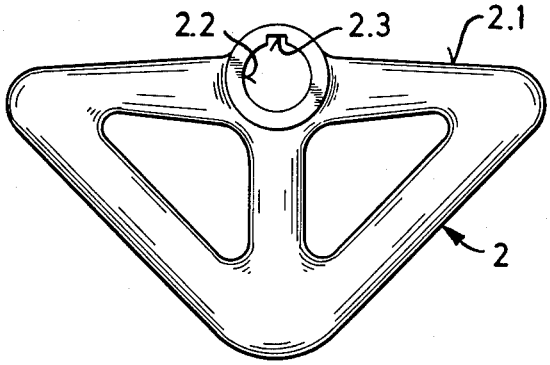
Figure 4:
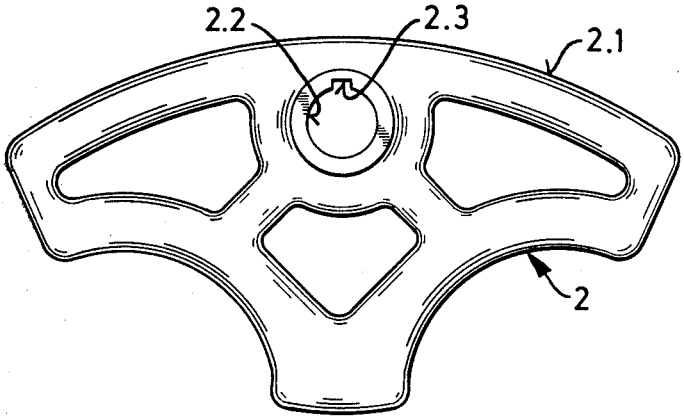
Figure 5:
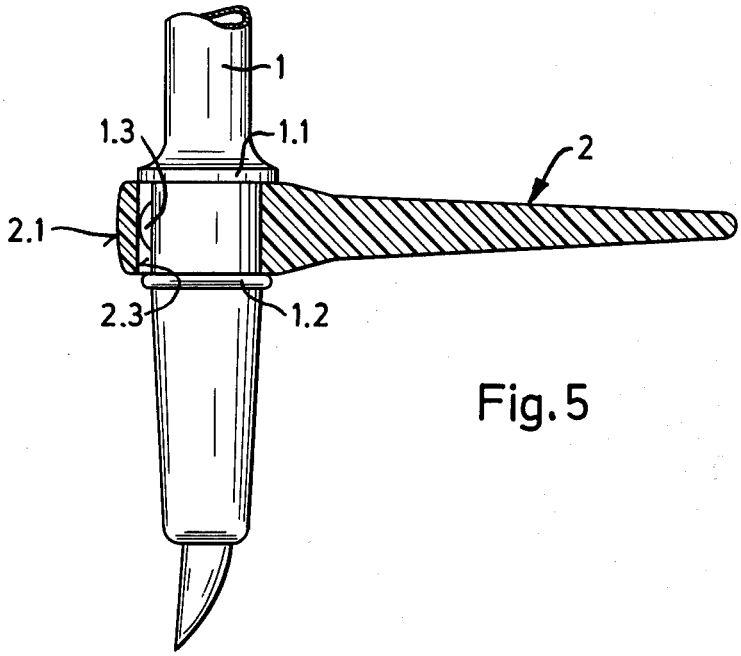
FIG. 5 shows, in section, the snow disk attached to the staff.

The snow disk 2 attached to the lower end of the staff 1 has been shaped to be asymmetric in such manner that its front edge 2.1 lies close to the staff, whereby only the rear edge and/or lateral edges of the disk 2 extends to form the supporting areas of the disk. The front edge 2.1 of the disk 2 is understood to be that side of the disk which is substantially opposite to the hand strap 3.

One way of affixing the disk is seen from FIGS. 2 to 5, wherein the hole 2.2 in the disk meant for the sleeve on the staff has been provided with an indentation 2.3, with which the projection 1.3 on the sleeve engages, thus preventing the turning of the disk out of the said position. The disk 2 may be replaceably mounted between annular shoulders 1.1 and 1.2 on the sleeve.

Figure 6:
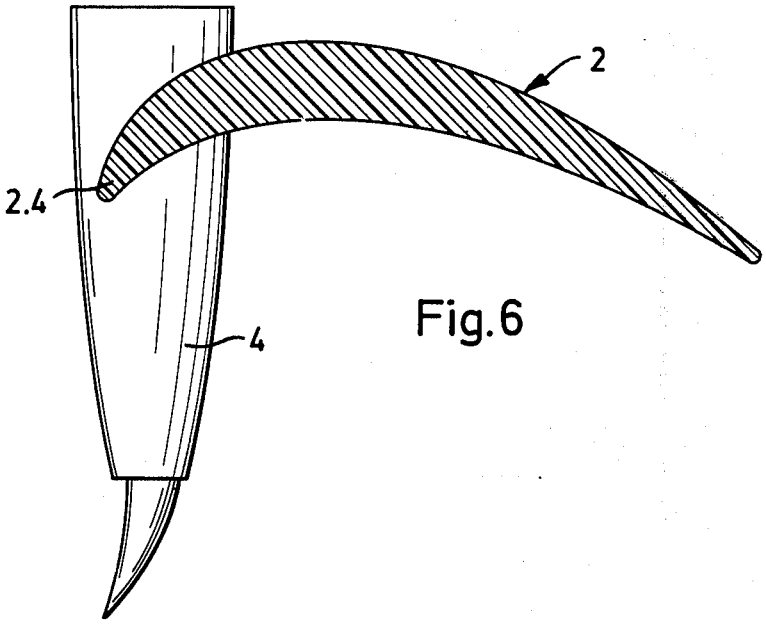
FIG. 6 shows a snow disk according to an embodiment of the invention.

In the embodiment of FIG. 6 the disk 2 has been manufactured as a pressed plastic article to be integral with the sleeve 4. This embodiment is expressly rendered possible by the fact that the disk, according to the invention, may be rigid in its central area or, even in its entirety. Furthermore, in FIG. 6 an embodiment is presented in which the front edge of the disk 2 curves downwardly to form a claw 2.4. A more advantageous holding quality is hereby achieved in certain snow conditions.

When a disk according to the invention is used, the length of the spike part of the disk can be made considerably less than normal without incurring any impairment of the holding of the staff during the pushing phase.

As a result of the short spike portion and the asymmetric location of the front edge, the force counteracting the tilting of the staff and retarding the skiing is considerably reduced, since as a rule the front edge of the disk is also displaced or may be displaced within the snow during the tilting motion.

As a result of the smaller forces encountered, and because the staff is not expected to undergo any bending, the staff as well as the disk can be dimensioned to be considerably lighter.

I claim:

1. An asymetric disk for a ski staff with hand straps, said disk having a front edge in close proximity to the staff, at least one of the rear edge and lateral edge of said disk only extending to form the bearing surfaces of the disk, said hand straps being attached to said staff on the side of said rear edge.

2. A disk as defined in claim 1 wherein said disk is rigid at its central area.

3. The disk as defined in claim 1 including key means on said staff and extending into a key slot in said disk for keying said disk to said staff and preventing thereby the rotation of said disk on said staff.

4. The disk as defined in claim 1 including a sleeve member integral with said disk.

5. The disk as defined in claim 4 wherein the front edge of said disk curves downwardly in the shape of a claw in said sleeve.

6. The disk as defined in claim 1 wherein the distance of said disk from the point of the staff is less than 7 centimeters.

7. The disk as defined in claim 1 including key means on said staff and extending into key slot in said disk for inhibiting rotation of said disk on said staff, said key slot on said disk being in a bore of said disk surrounding said staff, the longitudinal axis of said key slot being directed along the front edge of said disk, said disk having a rigid central area.

* * * * *

UNITED STATES PATENT AND TRADEMARK OFFICE

CERTIFICATE OF CORRECTION

PATENT NO. : B1 3,963,254

DATED : June 7, 1988

INVENTOR(S) : Yrjo Aho

It is certified that error appears in the above-identified patent and that said Letters Patent is hereby corrected as shown below:

Claim 19, line 1:
After "The" insert --ski--.

Claim 23, line 3:
After "upper" insert --pole--.

Signed and Sealed this

Eighth Day of November, 1988

*Attest:*

*Attesting Officer*

DONALD J. QUIGG

*Commissioner of Patents and Trademarks*

REEXAMINATION CERTIFICATE (865th)

United States Patent [19]

Aho

[11] B1 3,963,254

[45] Certificate Issued Jun. 7, 1988

[54] SNOW DISK FOR A SKI STAFF

[75] Inventor: Yrjo Aho, Westend, Finland

[73] Assignee: Exel Oy, Helsinki, Finland

Reexamination Request:
No. 90/001,138, Dec. 5, 1986

Reexamination Certificate for:

| | |
|---|---|
| Patent No.: | **3,963,254** |
| Issued: | **Jun. 15, 1976** |
| Appl. No.: | **561,771** |
| Filed: | **Mar. 24, 1975** |

[30] Foreign Application Priority Data

Mar. 28, 1974 [FI] Finland ..... 957/74

[51] Int. Cl. ..... A63C 11/24
[52] U.S. Cl. ..... 280/824
[58] Field of Search ..... 280/824, 819, 820

[56] References Cited

U.S. PATENT DOCUMENTS 3,150,879 9/1964 Head ..... 280/824

FOREIGN PATENT DOCUMENTS

| | | | |
|---|---|---|---|
| 134315 | 7/1933 | Austria | 280/824 |
| 400107 | 9/1923 | Fed. Rep. of Germany | 280/824 |
| 82376 | 9/1953 | Norway | 280/824 |
| 126776 | 10/1972 | Norway | 280/824 |

*Primary Examiner*—David M. Michell

[57] ABSTRACT

An asymetric disk for a ski staff with hand straps, in which the front edge of the disk is in close proximity to the staff. Only the rear edge and/or the lateral edge of the disk extend to form the bearing surfaces of the disk. The hand straps are attached to the staff on the side of the rear edge. The disk is rigid in its central area and is keyed to the shaft so as not to be rotatable thereon.

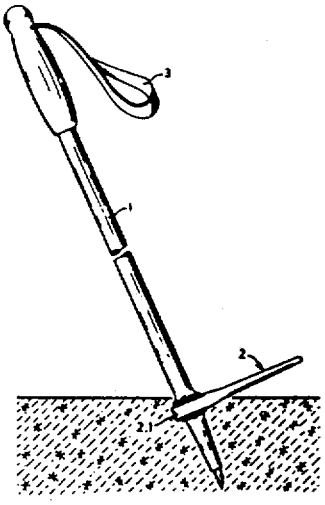

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3 and 6 are cancelled.

Claims 2, 4, 5 and 7 are determined to be patentable as amended.

New claims 8–24 are added and determined to be patentable.

2. A disk [as defined in claim 1] *for a ski staff with hand straps, said disk being asymmetric about its lateral axis, said staff being proximate to the front edge of said disk such that the rear edge and lateral edge of said disk extend to define the perimeter of the bearing surfaces of the disk and substantially no bearing surface extends forward of the staff, said hand straps being attached to said staff on the side of said rear edge and* wherein said disk is rigid at its central area.

4. [The] *A* disk [as defined in claim 1] *for a ski staff with hand straps, said disk being asymmetric about its lateral axis, said staff being proximate to the front edge of said disk such that the rear edge and lateral edge of said disk extend to define the perimeter of the bearing surfaces of the disk and substantially no bearing surface extends forward of the staff, said hand straps being attached to said staff on the side of said rear edge, said staff further* including a sleeve member integral with said disk.

5. [The disk as defined in claim 4] *An asymmetric disk for a ski staff with hand straps, said disk having a front edge in close proximity to the staff, at least one of the rear edge and lateral edge of said disk only extending to form the bearing surfaces of the disk, said hand straps being attached to said staff on the side of said rear edge including a sleeve member integral with said disk* wherein the front edge of said disk curves downwardly in the shape of a claw in said sleeve.

7. [The] *A* disk [as defined in claim 1] *for a ski staff with hand straps, said disk being asymmetric about its lateral axis, said staff being proximate to the front edge of said disk such that the rear edge and lateral edge of said disk extend to define the perimeter of the bearing surfaces of the disk and substantially no bearing surface extends forward of the staff, said hand straps being attached to said staff on the side of said rear edge of said staff* including key means on said staff and extending into key slot in said disk for inhibiting rotation of said disk on said staff, said key slot on said disk being in a bore of said disk surrounding said staff, the longitudinal axis of said key slot being directed along the front edge of said disk, said disk having a rigid central area.

*8. A ski staff assembly comprising a staff having a hand strap, and a disk that is asymmetric about its lateral axis, the disk having an opening receiving said staff and being rigid at its area adjacent said staff, the disk being coupled to the staff with said hand strap extending from the staff opposite a front edge of the disk, said staff being proximate said front edge such that the rear and lateral edges of said disk together with said staff define the limits of the perimeter of the substantially sole snow-engaging surface of the disk.*

*9. The ski staff assembly in claim 8 in which said disk is rigid in its entirety.*

*10. The ski staff assembly in claim 8 or 9 in which said staff defines an elongated upper portion and a lower sleeve portion extending rigidly downwardly from said upper pole portion and in which said disk is rigidly attached to said sleeve portion.*

*11. The ski staff assembly in claim 10 further having a snow penetrating portion below said disk.*

*12. A ski staff assembly comprising a staff defining an elongated upper pole portion and an elongated lower sleeve portion extending rigidly downwardly from said upper pole portion; a hand strap on said pole portion; and a disk rigidly affixed to the sleeve portion in such a manner that the disk is asymmetric about its lateral axis and the front edge of the disk is proximate to a vertical axis passing through the sleeve portion such that the perimeter of the substantially sole snow-engaging surface of the disk includes the rear and lateral edges of said disk and said sleeve portion, said hand strap extending from said staff opposite said front edge.*

*13. The ski staff in claim 12 in which said disk and said sleeve portion are integrally formed.*

*14. The ski staff in claim 13 in which said sleeve portion has a snow penetrating portion below said disk.*

*15. The ski staff in claim 14 in which said snow penetrating portion is substantially aligned with said vertical axis.*

*16. The ski staff in claim 12 further having a snow penetrating portion below said disk.*

*17. The ski staff in claim 16 in which said snow penetrating portion is substantially aligned with said vertical axis.*

*18. A ski staff assembly comprising a staff having a hand strap and a disk assembly nonrotatably affixed to the staff, said disk assembly comprising a disk member that is asymmetric about its lateral axis and rigidly interconnected to a sleeve member, said sleeve member defining an upper portion affixed to the staff and a lower snow penetrating portion, said disk member having a downwardly curved front edge defining a claw in said sleeve member and proximate a vertical axis passing through said snow penetrating portion and at least one of a rear edge and a lateral edge which define the perimeter of the substantially sole snow-engaging surface of the disk, said hand strap extending from said staff opposite said front edge.*

*19. The staff assembly in claim 18 in which said disk member and said sleeve member are integrally formed.*

*20. The ski staff assembly in claim 19 in which said disk assembly is made from plastic molded to the desired shape.*

*21. A ski staff assembly comprising a staff having a hand strap, and an asymmetric disk having a front edge and an opening therethrough receiving said staff proximate said front edge, the disk being coupled to the staff with said hand strap extending from the staff opposite said front edge of the disk, the disk including at least one of a rear edge and a lateral edge which define the perimeter of the substantially sole snow-engaging surface of the disk, said disk being rigid in its entirety, said staff defining an elongated upper pole portion and a lower sleeve portion extending rigidly downwardly from said upper pole portion, said disk being rigidly attached to said sleeve portion, and the front*

*edge of said disk curving downwardly in the shape of a claw laterally of said sleeve portion.*

*22. A ski staff assembly comprising a staff having a hand strap, and an asymmetric disk having a front edge and an opening therethrough receiving said staff proximate said front edge, the disk being coupled to the staff with said hand strap extending from the staff opposite said front edge of the disk, the disk being rigid at its area adjacent said staff and further including at least one of a rear edge and a lateral edge which define the perimeter of the substantially sole snow-engaging surface of the disk, said staff defining an elongated upper pole portion and a lower sleeve portion extending rigidly downwardly from said upper pole portion, said disk being rigidly attached to said sleeve portion and the front edge of said disk curving downwardly in the shape of a claw laterally of said sleeve portion.*

*23. A ski staff assembly comprising a staff defining an elongated upper pole portion and a lower sleeve portion extending rigidly downwardly from said upper portion; a hand strap on said pole portion; and an asymmetric disk rigidly affixed to the sleeve portion in such a manner that a front edge of the disk is proximate a vertical axis passing through the sleeve portion, said disk including at least one of a rear edge and a lateral edge which define the perimeter of the substantially sole snow-engaging surface of the disk, said hand strap extending from said staff opposite said front edge, said disk and said sleeve portion being integrally formed, said sleeve portion having a snow penetrating portion below said disk, said snow penetrating portion being substantially aligned with said vertical axis; and the front edge of said disk curving downwardly in the shape of a claw laterally of said sleeve portion.*

*24. A ski staff assembly comprising a staff defining an elongated upper pole portion and a lower sleeve portion extending rigidly downwardly from said upper pole portion; a hand strap on said pole portion; and an asymmetric disk rigidly affixed to the sleeve portion in such a manner that a front edge of the disk is proximate a vertical axis passing through the sleeve portion, said disk including at least one of a rear edge and a lateral edge which define the perimeter of the substantially sole snow-engaging surface of the disk, said hand strap extending from said staff opposite said front edge, said staff further having a snow penetrating portion below said disk, said snow penetrating portion being substantially aligned with said vertical axis, and the front edge of said disk curving downwardly in the shape of a claw laterally of said sleeve portion.*

* * * * *